US011177104B2

(12) United States Patent
Taylor et al.

(10) Patent No.: US 11,177,104 B2
(45) Date of Patent: Nov. 16, 2021

(54) DEVICE FOR CONTROLLING ELECTRON FLOW AND METHOD FOR MANUFACTURING SAID DEVICE

(71) Applicant: Evince Technology Limited, Newcastle upon Tyne (GB)

(72) Inventors: Gareth Andrew Taylor, Newcastle upon Tyne (GB); David Andrew James Moran, Glasgow (GB); John Peter Carr, Dunfermline (GB); Paul Farrar, Chilton (GB); Mark Kieran Massey, Barnard Castle (GB)

(73) Assignee: Evince Technology Limited, Newcastle upon Tyne (GB)

( * ) Notice: Subject to any disclaimer, the term of this patent is extended or adjusted under 35 U.S.C. 154(b) by 0 days.

(21) Appl. No.: 17/110,678

(22) Filed: Dec. 3, 2020

(65) Prior Publication Data

US 2021/0159039 A1 May 27, 2021

Related U.S. Application Data

(62) Division of application No. 16/632,829, filed as application No. PCT/EP2018/069965 on Jul. 24, 2018.

(30) Foreign Application Priority Data

Jul. 28, 2017 (EP) ..... 17183855

(51) Int. Cl.
*H01J 19/30* (2006.01)
*H01J 19/44* (2006.01)
(Continued)

(52) U.S. Cl.
CPC ..... *H01J 19/44* (2013.01); *H01J 9/18* (2013.01); *H01J 19/30* (2013.01); *H01J 19/38* (2013.01); *H01J 19/48* (2013.01); *H01J 21/105* (2013.01)

(58) Field of Classification Search
CPC .. H01J 19/38; H01J 19/44; H01J 19/48; H01J 21/105
(Continued)

(56) References Cited

U.S. PATENT DOCUMENTS 4,983,878 A ‡ 1/1991 Lee ..... H01J 1/3042 216/11
6,554,673 B2 ‡ 4/2003 Pehrsson ..... B82Y 10/00 313/30
(Continued)

FOREIGN PATENT DOCUMENTS

EP 1594150 A1 ‡ 11/2005 ..... H01J 23/06
EP 1594150 A1 11/2005
(Continued)

OTHER PUBLICATIONS

Sun et al., High Conductivity Micro-Wires in Diamond Following Arbitrary Paths, Applied Physics Letters, 2014, 105:231105, 4 pages.‡
(Continued)

*Primary Examiner* — Christopher M Raabe
(74) *Attorney, Agent, or Firm* — Quarles & Brady LLP

(57) ABSTRACT

A device for controlling electron flow is provided. The device comprises a cathode, an elongate electrical conductor embedded in a diamond substrate, an anode, and a control electrode provided on the substrate surface for modifying the electric field in the region of the end of the conductor. A method of manufacturing the device is also provided.

13 Claims, 15 Drawing Sheets

(51) Int. Cl.

| | |
|---|---|
| ***H01J 9/18*** | (2006.01) |
| ***H01J 19/38*** | (2006.01) |
| ***H01J 19/48*** | (2006.01) |
| ***H01J 21/10*** | (2006.01) |

(58) Field of Classification Search
USPC ..... 313/308
See application file for complete search history.

(56) References Cited

U.S. PATENT DOCUMENTS

| | | | | |
|---|---|---|---|---|
| 7,365,482 | B2 * | 4/2008 | Ryu | B82Y 10/00 313/309 |
| 7,411,341 | B2 * | 8/2008 | Hudspeth | H01J 9/025 313/309 |
| 7,521,851 | B2 * | 4/2009 | Tolt | H01J 1/304 313/296 |
| 2005/0127351 | A1 ‡ | 6/2005 | Tolt | H01J 3/022 257/10 |
| 2008/0088220 | A1 ‡ | 4/2008 | Noh | H01J 31/127 313/34 |
| 2010/0308342 | A1 ‡ | 12/2010 | Taylor | H01L 21/0405 257/77 |
| 2013/0168635 | A1 ‡ | 7/2013 | Cheatham, III | H01J 29/02 257/10 |

FOREIGN PATENT DOCUMENTS

| | | | | |
|---|---|---|---|---|
| EP | 2605282 | A2 ‡ | 6/2013 | H01L 29/417 |
| EP | 2605282 | A2 | 6/2013 | |
| JP | 2000106435 | A ‡ | 4/2000 | |
| JP | 2000106435 | A | 4/2000 | |

OTHER PUBLICATIONS

Prins, Ion-Implanted Structures and Doped Layers in Diamond, Materials Science Reports, 1992, 7:271-364.‡
Williams, Nanocrystalline Diamond, Diamond & Related Materials, 2011, 20:621-640.‡
PCT International Search Report and Written Opinion, PCT/EP2018/069965, dated Oct. 31, 2018, 15 pages.‡
Takeuchi et al., Recovery of Negative Electron Affinity by Annealing on (111) Oxidized Diamond Surfaces, Diamond & Related Materials, 2009, 18(2-3):206-209.‡
Hees et al., Piezoelectric Actuated Micro-Resonators Based on the Growth of Diamond on Aluminum Nitride Thin Films, Nanotechnology, 2013, 24:025601, 7 pages.‡
Maier et al., Electron Affinity of Plasma-Hydrogenated and Chemically Oxidized Diamond (100) Surfaces, Physical Review B, 2001, 64:165411, 7 pages.‡
Hees et al., Electrostatic Self-Assembly of Diamond Nanoparticles, Chemical Physics Letters, 2011, 509:12-15.‡
Geis et al., Diamond Emitters Fabrication and Theory, Journal of Vacuum Science & Technology B, 1996, 14(3):2060-2067.‡

* cited by examiner
‡ imported from a related application

DEVICE FOR CONTROLLING ELECTRON FLOW AND METHOD FOR MANUFACTURING SAID DEVICE

CROSS REFERENCE TO RELATED APPLICATION

This application is a divisional of U.S. patent application Ser. No. 16/632,829 filed on Jan. 21, 2020, which is a U.S. National Stage of PCT/EP2018/069965 filed on Jul. 24, 2018 which claims the benefit of European Patent Application No. 17183855.0, filed on Jul. 28, 2017, the entire contents of which are incorporated herein by reference.

FIELD OF THE INVENTION

The present disclosure relates to devices for controlling electron flow and relates particularly, but not exclusively, to field-modulating devices comprising elongate conductors embedded in diamond. The present disclosure also relates to a method of manufacturing devices for controlling electron flow.

BACKGROUND

Heated thermionic cathodes are known for the generation of free electrons. Devices incorporating these cathodes have a number of drawbacks, which include: the requirement to heat the cathode to around one thousand degrees Celsius to one thousand two hundred degrees Celsius; mechanical fragility of the cathode structure; poisoning of the cathode and/or device by additives, such as barium, used to enhance the emission process; and limited emission current density of typically two to three Amps per square centimetre which, if increased, exponentially decreases the life of the cathode.

Vacuum field emission electron sources (also known as cold cathodes) have been the subject of development efforts for over four decades as a potentially superior replacement to the heated thermionic cathode. They typically make use of semiconductor techniques in their manufacture, where the goal is to make a sharp feature that enhances the local electric field at its point from which electrons are expelled into the vacuum. A problem with any field emission source made in this way is that the emitter is exposed to an imperfect vacuum. As a result, a small amount of gas inevitably remains that will be partially ionised by the emitted electrons and these ions, which can be tens of thousands times heavier than the electrons, are attracted back to the emitter where they impact and cause damage. Therefore, all devices made in this way degrade with time.

Potential applications of vacuum field emission devices include flat panel displays, 2D sensors, direct writing e-beam lithography, microwave amplifier devices such as travelling wave tubes and klystrons, gas switching devices such as thyratrons, materials deposition and curing systems, x-ray generators, electron microscopes, as well as various other forms of instrumentation. However, all of these applications require the device to meet part or all of the following requirements: ability to modulate electron emission at a low voltage, ideally less than ten Volts; high emission current density; high emission uniformity over large area; high energy efficiency; resistance to ion bombardment; chemical and mechanical robustness; operation without the need to supply power to pre-heat the cathode; instantaneous generation of electrons upon demand; generation of collimated electron beam.

Accordingly, there is a need for a robust vacuum field emission source with low modulation voltage, high current density, high current uniformity and high efficiency.

BRIEF DESCRIPTION OF THE DRAWINGS

The present disclosure will now be described, by way of example only and not in any limitative sense, with reference to the accompanying drawings, in which.

DETAILED DESCRIPTION

Figure 1:
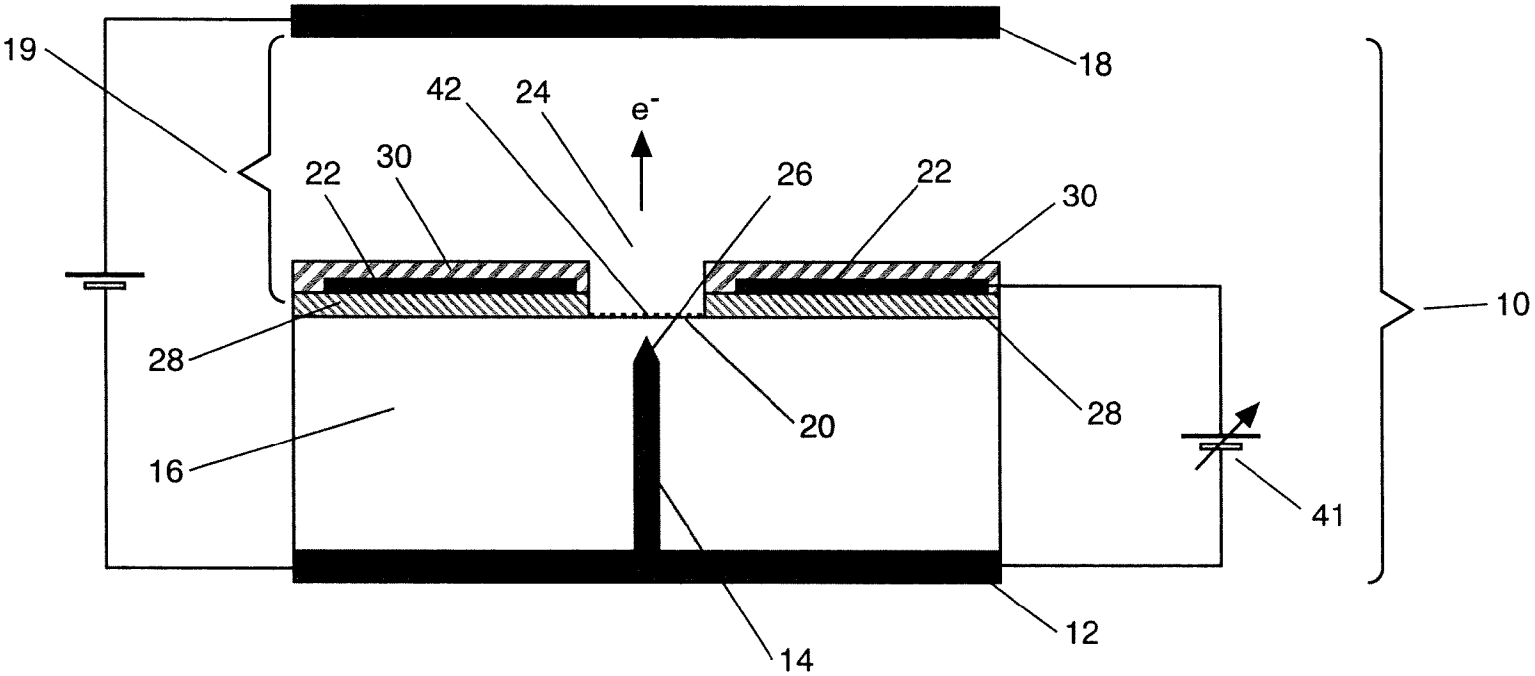
FIG. 1 shows a cross-sectional side view of an electron emitting device of a first embodiment of the present disclosure.

Referring to FIG. 1, a device 10 for controlling electron flow is shown comprising a cathode 12, an electron source in the form of an elongate electrical conductor 14 embedded in a diamond substrate 16 and in contact and electrical communication with the cathode 12, an anode 18 spaced from the surface 20 of the substrate 16 by a space or void 19, and a control electrode 22 arranged on the substrate surface 20. The diamond substrate 16 may comprise intrinsic diamond, nitrogen-doped diamond, or a combination of the two. The control electrode is shown comprising an aperture 24, the periphery of which surrounds an end 26 of the conductor 14. The exposed portion of surface 20 in proximity to the end 26 of the conductor 14 is treated to exhibit negative electron affinity. Throughout the figures, NEA-treated surfaces 42 are indicated by dashed lines. The control electrode 22 is isolated from the substrate 16 using an insulating material 28 and further encapsulated from the vacuum using an additional insulating layer 30.

Referring to FIGS. 2 to 4, manufacture of devices for controlling electron emission in which the control electrode 22 is shown embedded in insulating materials 18 is shown.

Figure 2A:
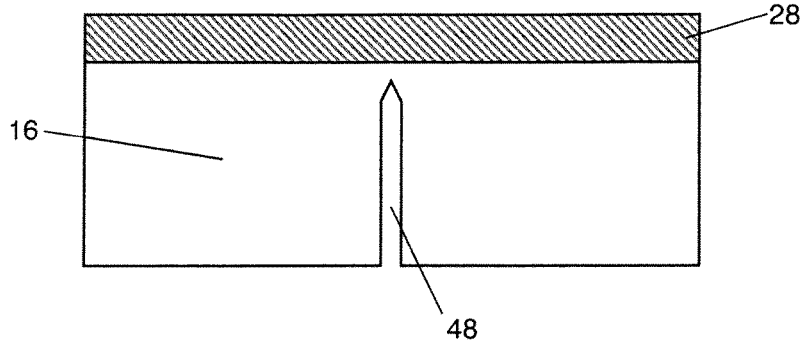
FIGS. 2A to 2C show a sequence of cross-sectional side views of an electron emitting device of a second embodiment of the present disclosure during manufacture thereof.
Figure 2B:
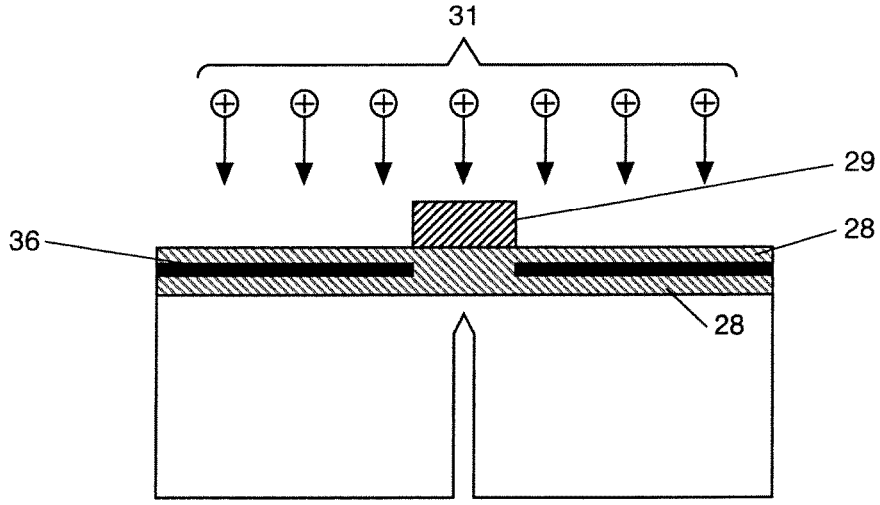
Figure 2C:
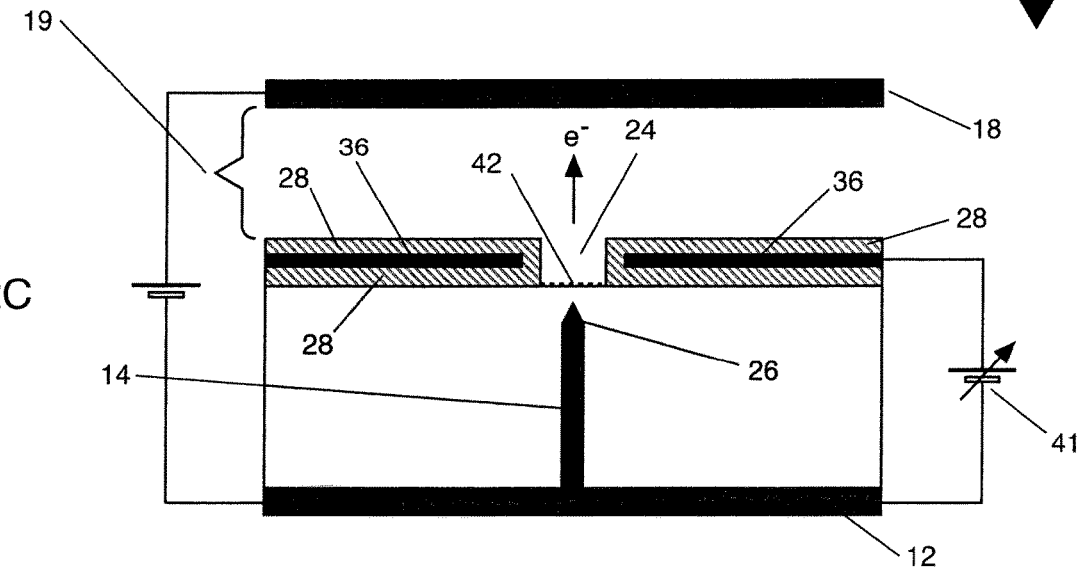

Referring to FIGS. 2A to 2C, the insulating material is a layer of nitrogen-doped diamond 28 grown using an epitaxy process as shown in FIG. 2A. The control electrode 22 is a sub-surface control electrode of graphitic carbon 36 within the nitrogen-doped diamond layer 28 as shown in FIG. 2B.

The graphitic carbon electrode 36 may be fabricated by selective ion implantation, by means of one or more of the following methods: using carbon ions as the ion species at a level of 10^16 per square centimetre or greater and a dose energy of between 200 kilo-electronVolt and three mega-electronVolt; using a focused or co-focused laser; and a combination of ultra-short laser pulse fabrication and high numerical aperture focusing. An implant mask 29 is placed in the region of the subsequent location of end 26 (FIG. 2C) of the conductor 14 prior to fabrication of the graphitic carbon electrode 36, thereby preventing growth of graphitic carbon within the portion of the nitrogen-doped diamond layer 28 immediately beneath the implant mask 29. In this case because the graphitisation occurs below the surface of 28 the upper insulating layer 30 is therefore achieved as a contiguous part of 28. The nitrogen-doped diamond 28 may be annealed after growth of the graphitic carbon electrode 36 to reinforce the graphitic damage in high-damage regions and to repair the damage in low-damage regions, thereby restoring the integrity of the nitrogen-doped diamond 28 and increasing the conductivity of the graphitic carbon electrode 36. Alternatively, the ion species 31 could include at least one of aluminium and boron.

Figure 3A:
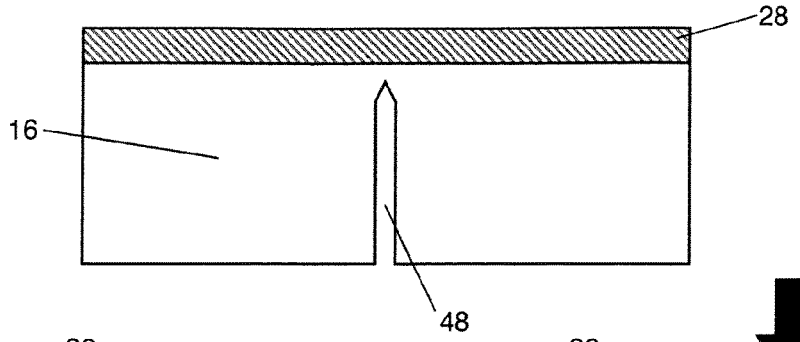
FIGS. 3A to 3D show a sequence of cross-sectional side views of an electron emitting device of a third embodiment of the present disclosure during manufacture thereof.
Figure 3B:
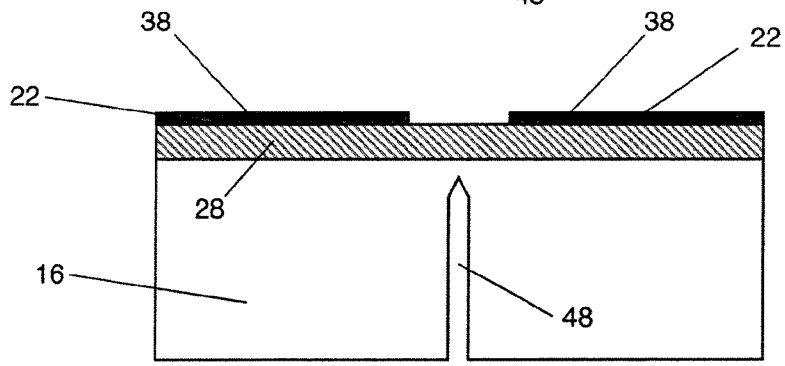
Figure 3C:
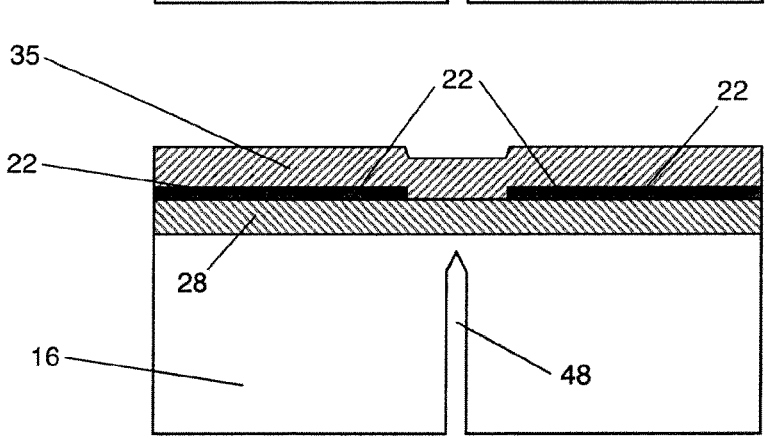
Figure 3D:
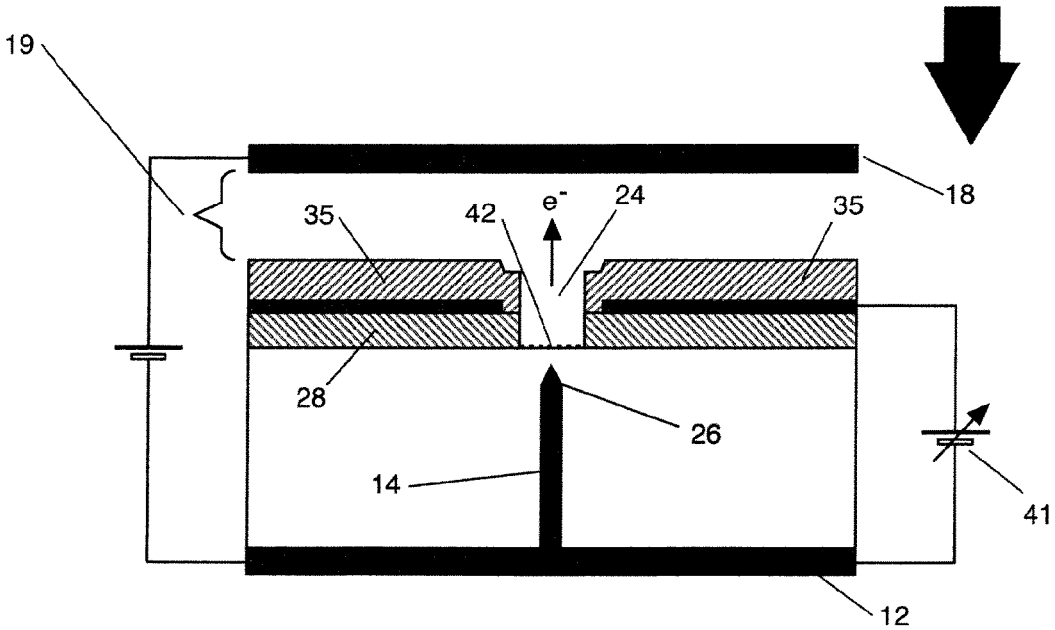

Referring to FIGS. 3A to 3D, the control electrode 22 is a patterned layer of metal 38, preferably a layer of iridium, deposited on a layer of nitrogen-doped diamond 28 (FIG. 3B), on top of which a further layer of heteroepitaxial nitrogen-doped diamond 35 is grown (FIG. 3C). One or more of the layers 28, 30 may be epitaxially grown. Iridium is preferred as the material for construction of the control electrode 22 to ensure a suitable lattice match to layers 28 and 35.

Figure 4A:
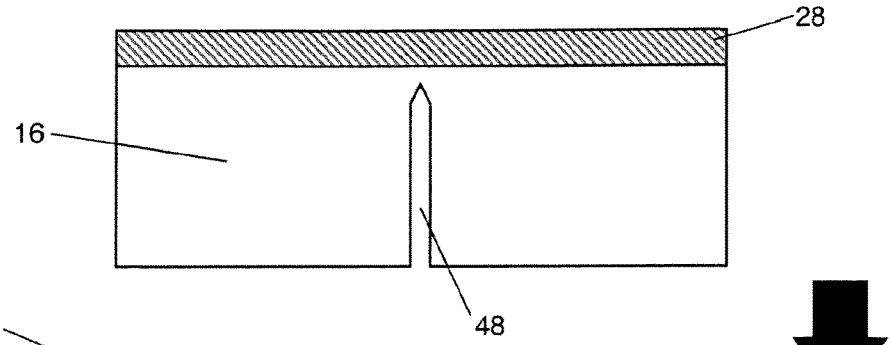
FIGS. 4A to 4D show a sequence of cross-sectional side views of an electron emitting device of a fourth embodiment of the present disclosure during manufacture thereof.
Figure 4B:
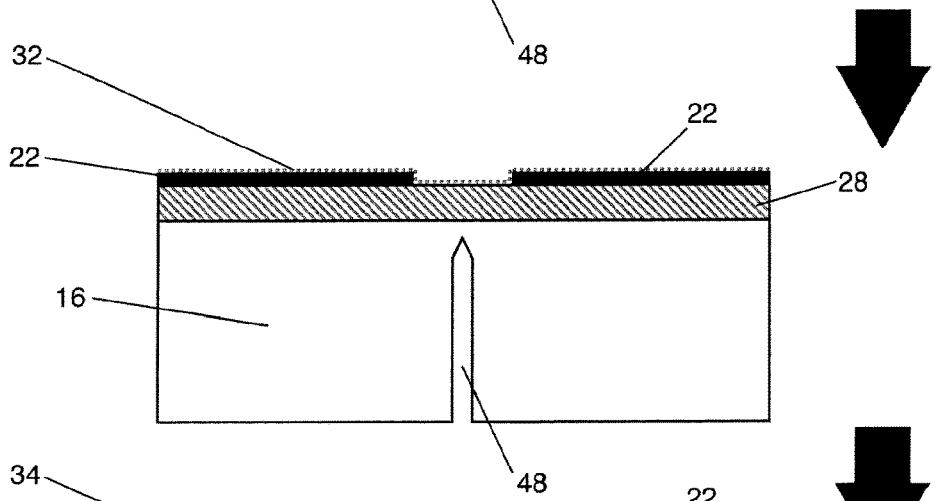
Figure 4C:
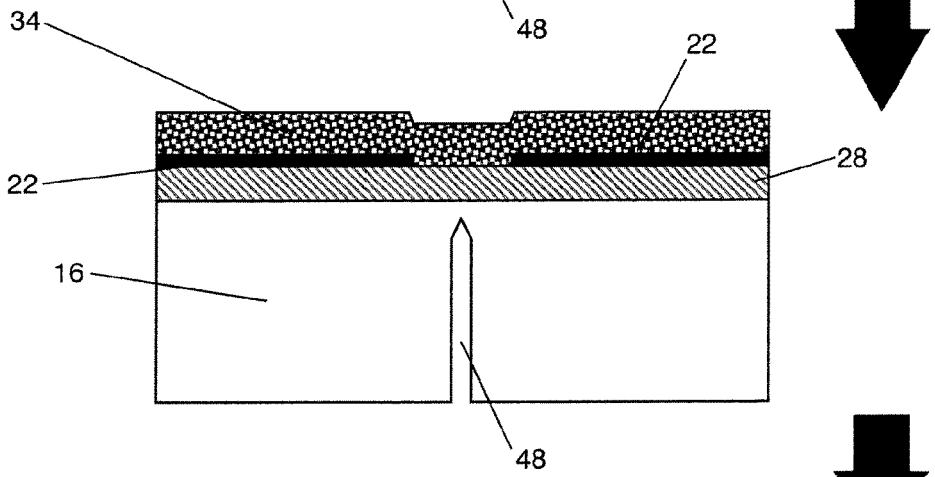
Figure 4D:
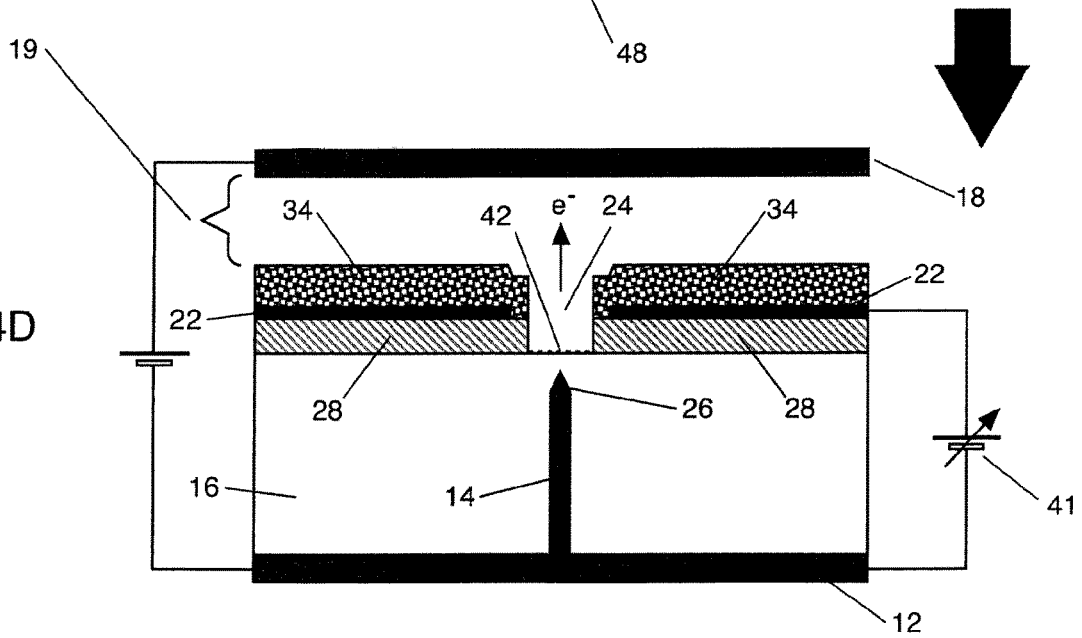

Referring to FIGS. 4A to 4D, the control electrode 22 is a patterned layer of metal 38 (FIG. 4B) deposited on a layer of nitrogen-doped diamond 28, on top of which a single particle thickness layer of nano-diamond powder 32 is deposited, which in turn acts as a seed layer for the epitaxial growth of a layer of nano-crystalline diamond 34, preferably using conventional plasma-enhanced chemical vapour deposition (PECVD) processes. By depositing nano-diamond powder 32 on the control electrode as a foundation for a nano-crystalline diamond layer 34 (FIG. 4C), the range of metals that are suitable for constructing the control electrode 22 is broadened. Furthermore, the control electrode 22 is encapsulated, thereby preventing it from being subject to degradation due to edge corona while isolating it from ion species that may be formed in the space between the substrate surface and the cathode 12 (FIG. 4D). This also prevents a leakage current of electrons from the tip 26 of the conductor 14 to the control electrode 22. The melting point of the metal layer 38 is preferably 1000 degrees Celsius or higher to ensure that the layer 38 can withstand temperatures associated with PECVD.

The nano-diamond powder can be made to selective adhere to the metal layer 38 through controlled annealing of the powder which, in turn, determines the zeta potential of the nano-diamond powder particle surface and hence the electrostatic attraction of particles to the target surface. In this way, the metal layer 38 can be selectively seeded so that nano-crystalline diamond 34 will be grown over the control electrode 22, while single crystal diamond may be grown on top of remaining exposed diamond, so as to effect a well-adhered encapsulation of the metallised layer.

The insulating material layers 28, 30, 34 shown in FIGS. 2 to 4 are selectively etched away once the control electrode 22 has been created to expose a portion of the substrate surface 20 in the vicinity of the aperture 24 and end 26 of the conductor 14. The etching may be performed using reactive ion etching with argon/oxygen and/or argon/chlorine mixtures, and/or ion beam assisted etching using xenon/nitrogen dioxide. After etching, the exposed portion 42 of the surface 20 is treated to exhibit negative electron affinity.

Figure 5A:
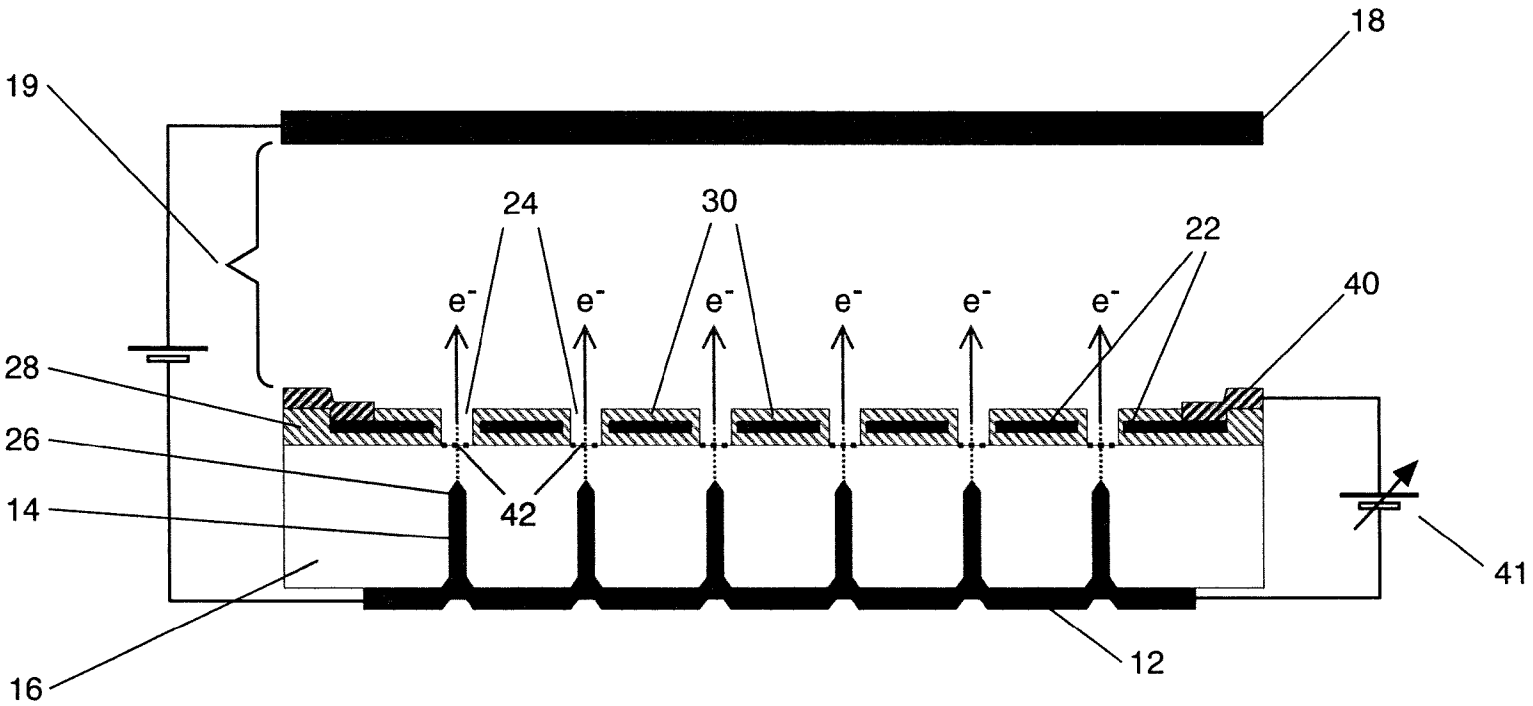
FIG. 5A shows a cross-sectional side view of an array of electron emitting devices according to any of the embodiments of FIGS. 1 to 4.
Figure 5B:
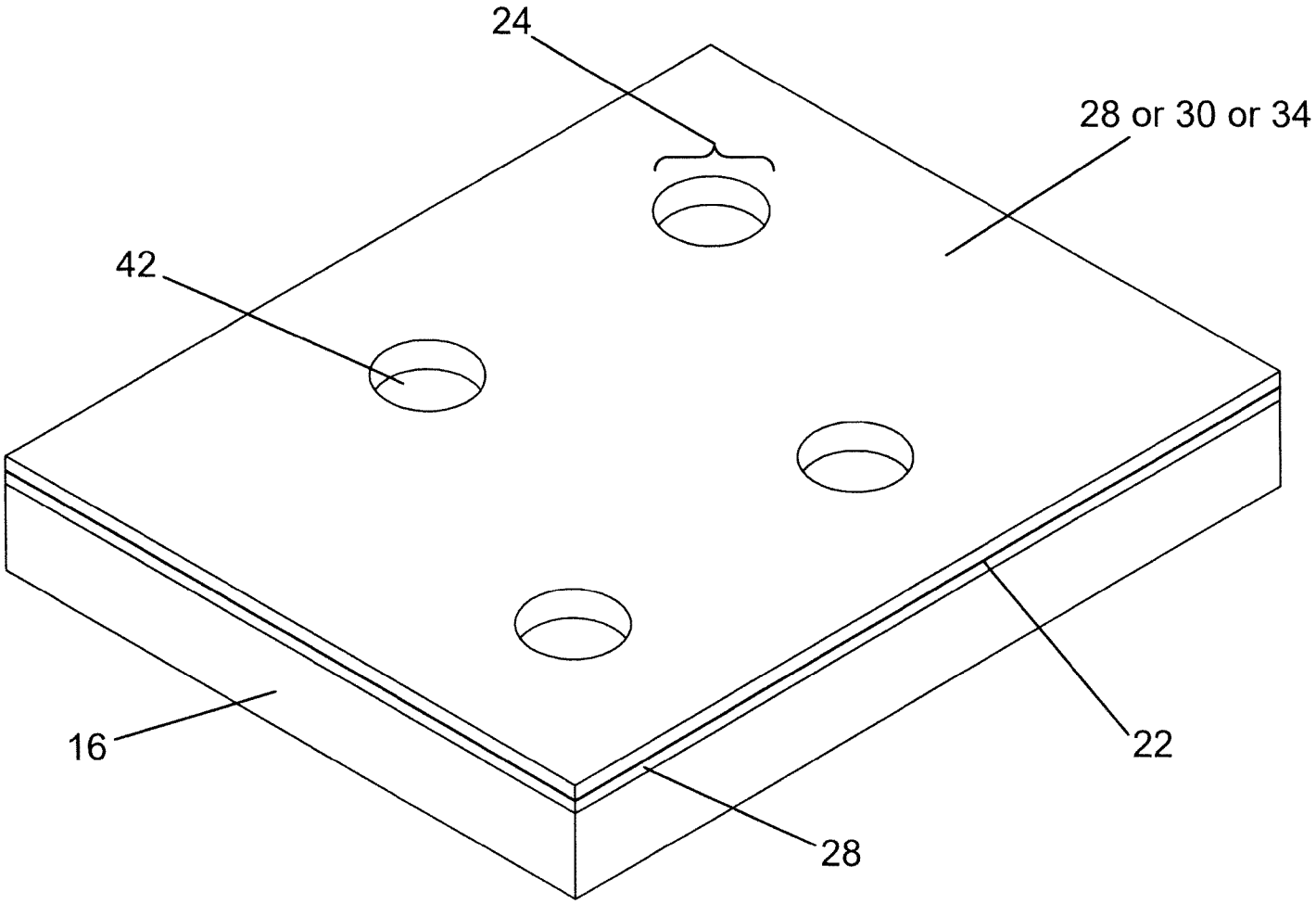
FIG. 5B shows a perspective view of any of the devices of the embodiments of FIGS. 2 to 5.
Figure 6A:
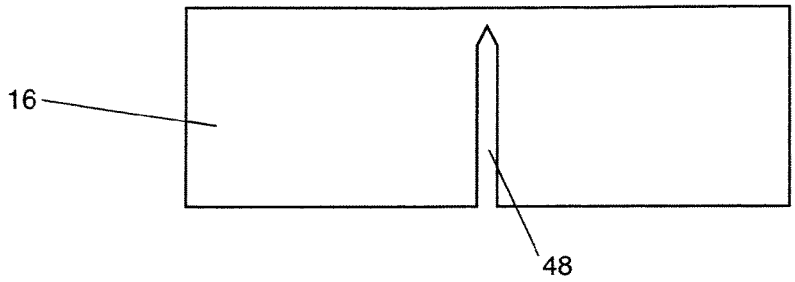
FIGS. 6A to 6D show a sequence of cross-sectional side views of an electron emitting device of a fifth embodiment of the present disclosure during manufacture thereof.
Figure 6B:
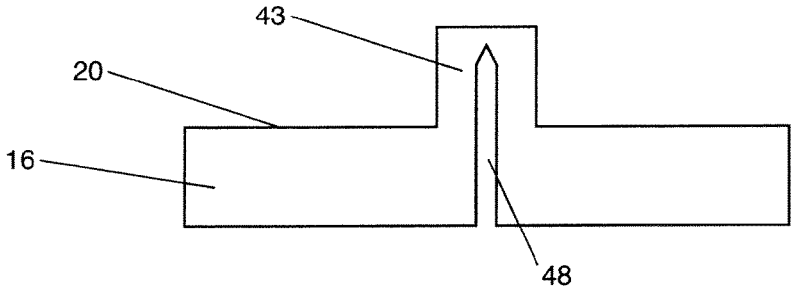
Figure 6C:
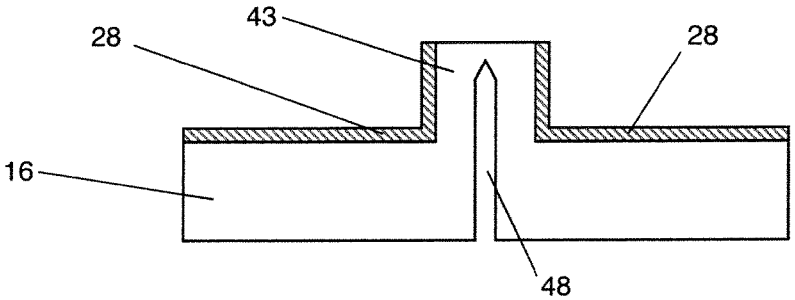
Figure 6D:
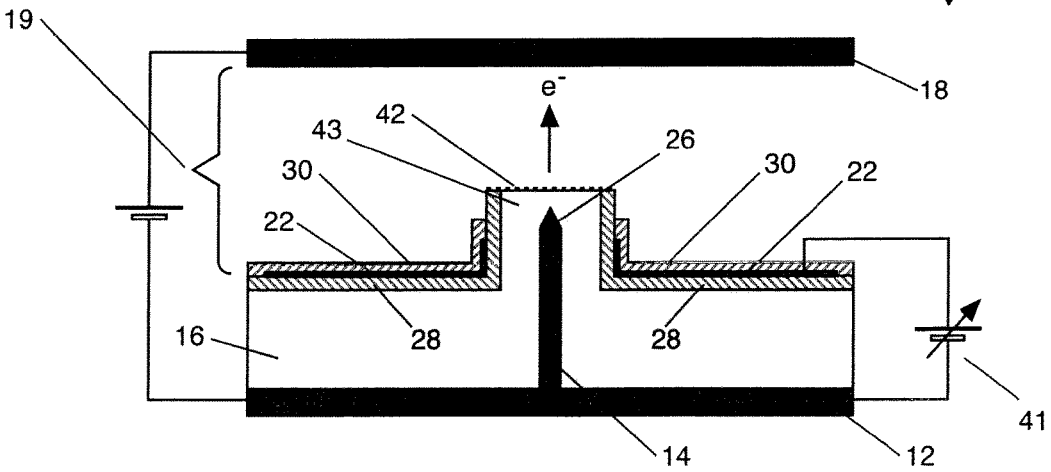
Figure 7A:
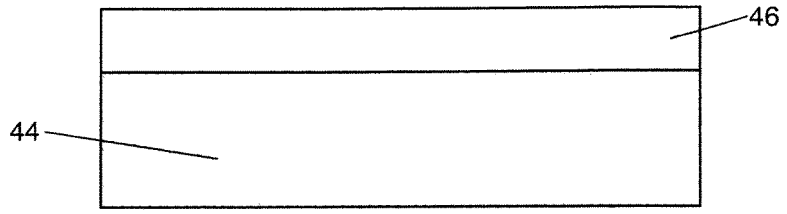
FIGS. 7A to 7D show a sequence of cross-sectional side views of an electron emitting device of a sixth embodiment of the present disclosure.
Figure 7B:
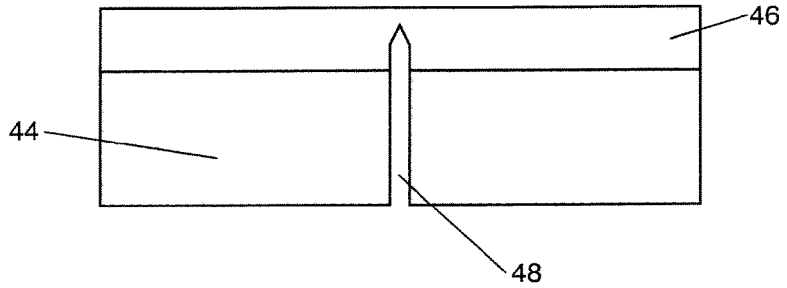
Figure 7C:
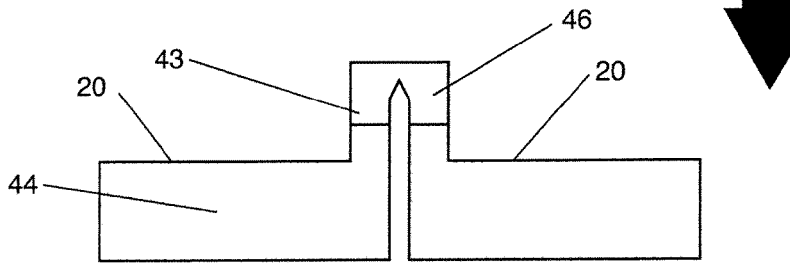
Figure 7D:
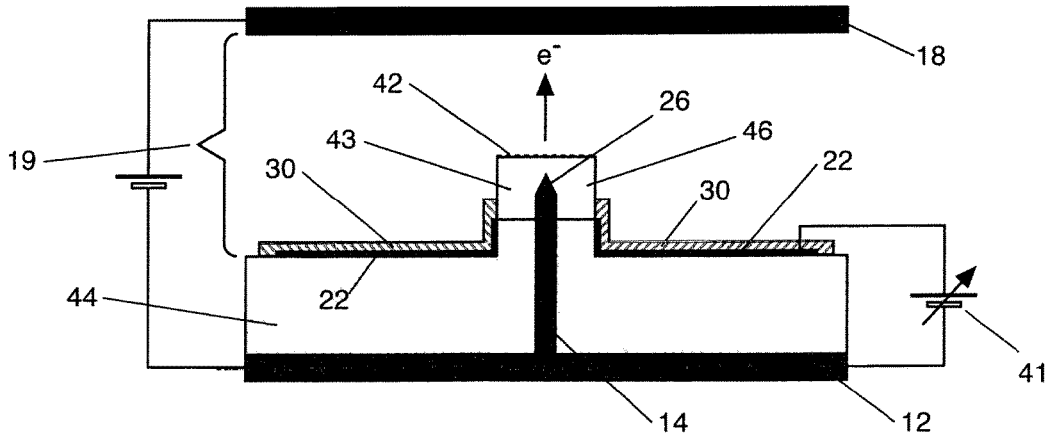
Figure 7E:
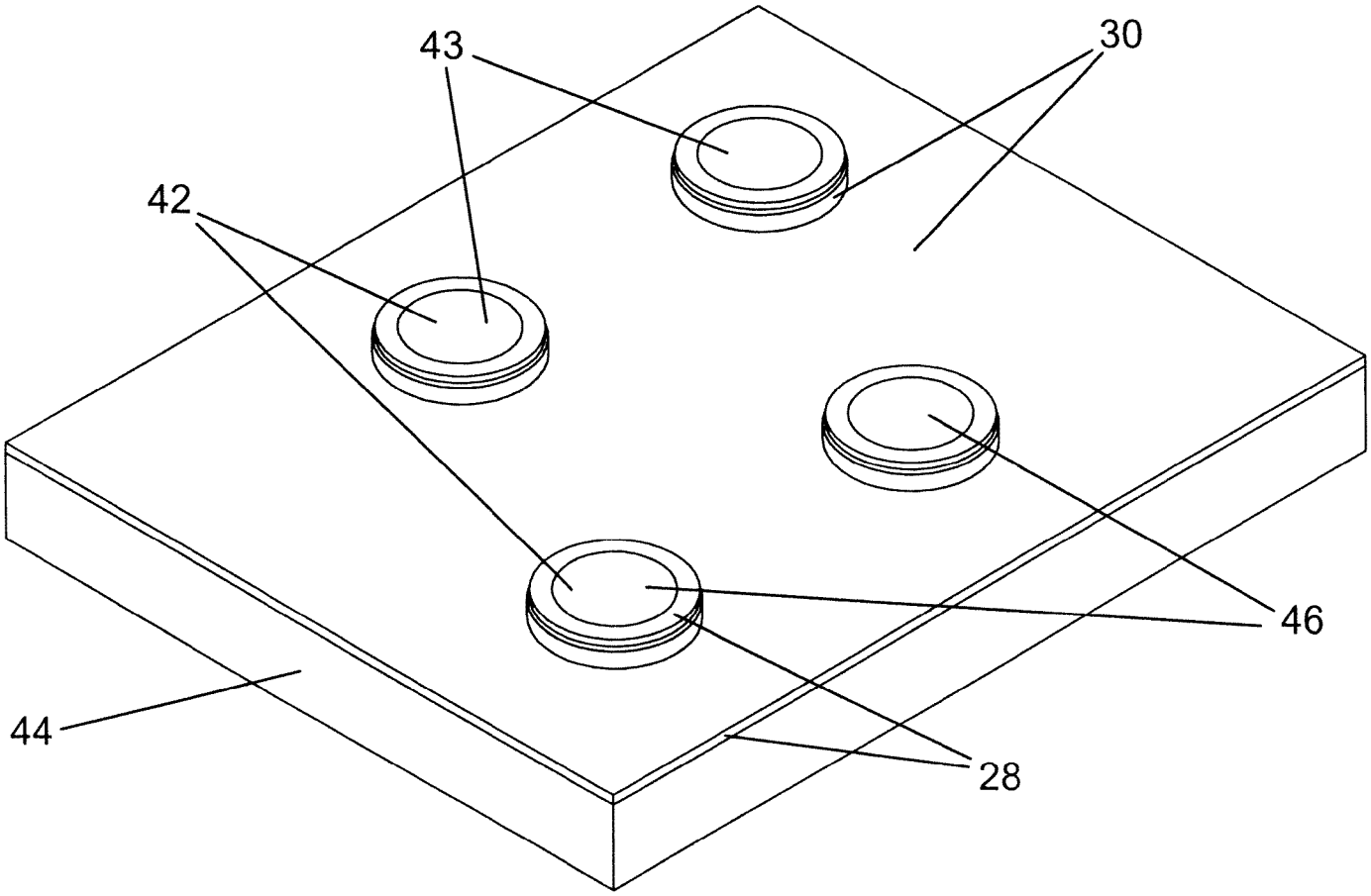
FIG. 7E shows a perspective view of the embodiment of FIGS. 7A to 7D.

Referring to FIGS. 5A and 5B, an array of conductors 14 is shown embedded in a diamond substrate 16. A corresponding array of control electrodes 22 is shown encapsulated in insulating materials 28 according to any one of the embodiments shown in FIGS. 2 to 4. Electrical connections 40 are shown in contact with the electrodes 22, and are connected to a power supply 41 for controlling the electron current density emitted by the conductors 14. The electrodes 22 are shown encapsulated in insulating material 28, and may be encapsulated in any insulating material 28, 30, 34 in accordance with one or more of the methods for encapsulating electrodes in insulating material described above with reference to FIGS. 2 to 4.

Referring to FIGS. 6A to 6D, a conductor 14 (FIG. 6D) is shown embedded in a substrate 16, a portion of which has been etched away to change the profile of the substrate from an initial configuration to a protrusion- or mesa-like shape 43 (FIG. 6B) prior to deposition on its surface 20 of a layer 28 (FIG. 6C) of nitrogen-doped diamond and electrode 22. A further layer 45 of nitrogen-doped diamond (FIG. 6D) is then deposited on the electrode 22 to complete the encapsulation of the electrode 22 in an insulating material. In the protrusion-like configuration, the end 26 of the conductor 14 and the substrate 16 are shown protruding through the aperture 24 of the electrode 22.

Figure 14A:
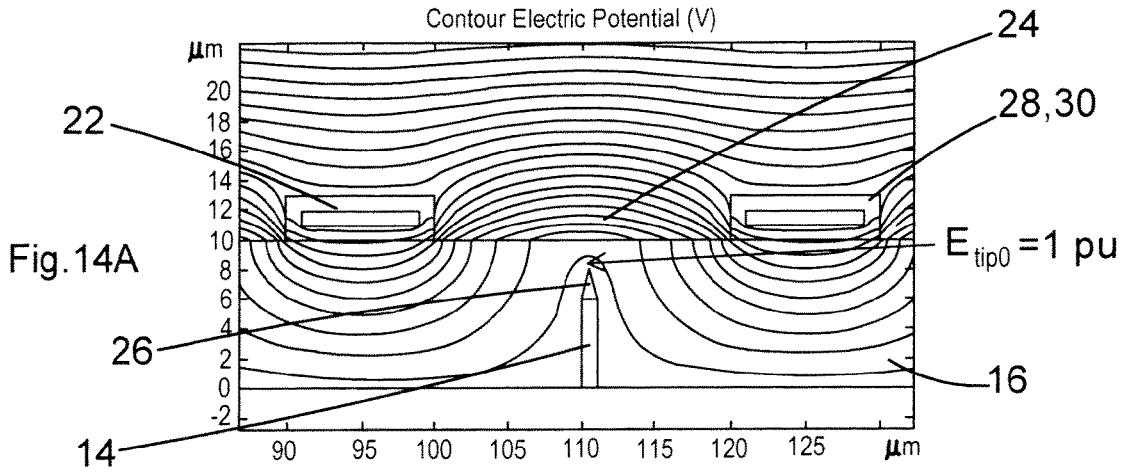
FIGS. 14A to 14C show the effect of control electrode location on the electric field at the electron emitter tip.
Figure 14B:
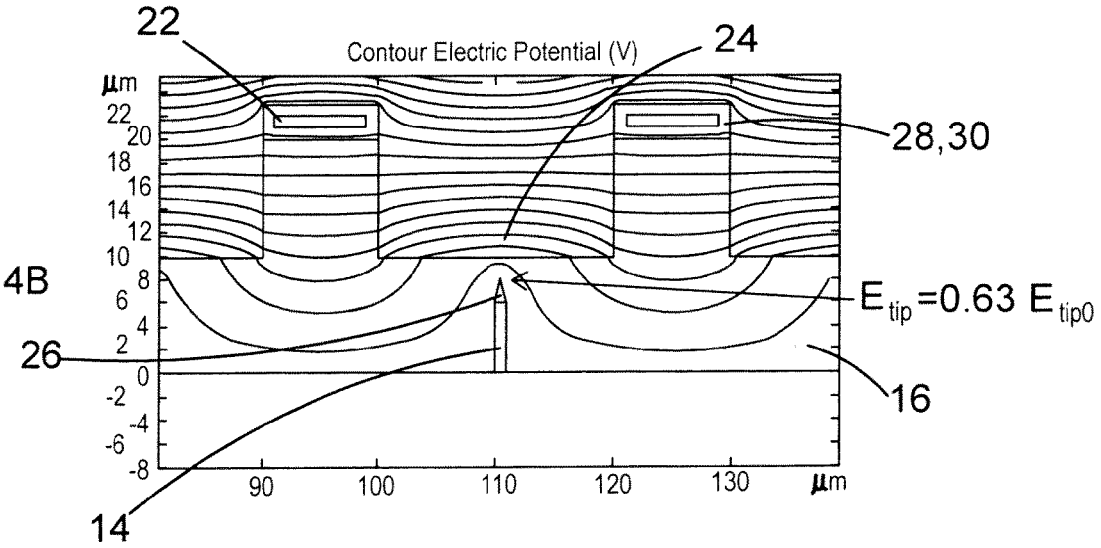
Figure 14C:
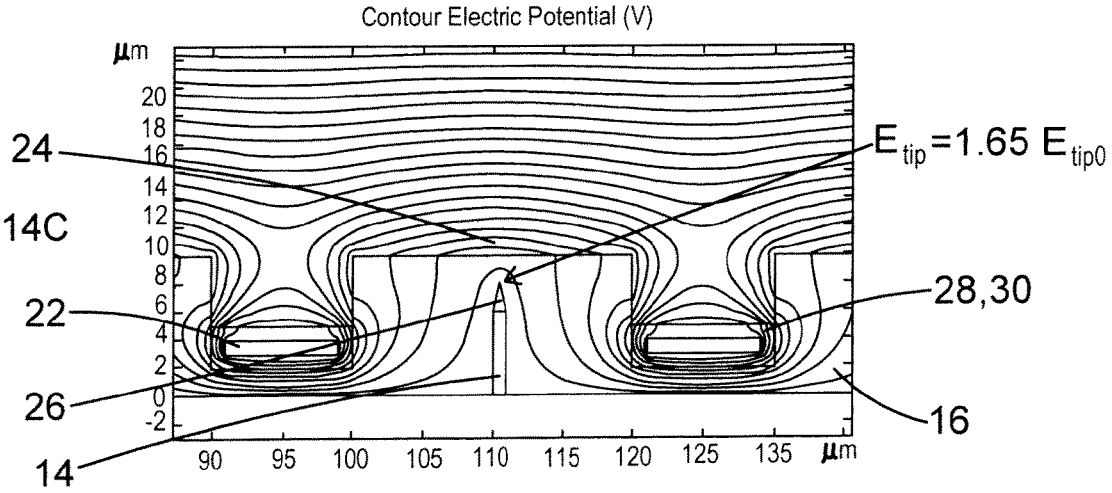

The behaviour of the shape 43 is explained with reference to FIGS. 14A to 14C, which show the effect of location of the control electrode 22 on the electric field distribution at the tip 26 of the conductor 14 through computer modelled electro-static voltage contour plots. The configuration of the overall model is as shown in FIG. 1. In all cases the control electrode is biased positive with respect to the conductor 14 but at a substantially lower voltage than is applied to an anode 18 (not visible in the analytical results shown). FIG. 14A shows a reference whereby the control electrode 22 is created on the plane upper surface 20 of the substrate 16 and encapsulated within an insulating layer 28, 30. In FIG. 14B a deeper aperture 24 is created so that the electrode 22 is significantly above the tip 26 of the conductor 14, causing a significant reduction in field enhancement around the conductor 14. In FIG. 14C, the control electrode 22 is recessed below the level of the tip 26 of the conductor 14, causing an enhancement of electric field at the tip 26 and therefore having the advantage of reducing the applied voltage required to initiate electron emission.

It will be appreciated by persons skilled in the art that further field enhancement could be achieved by further refinement of the control electrode 22 structure, either in the vertical z-axis as shown in FIG. 14, and/or by changing the width of the aperture 24.

Referring to FIGS. 7A to 7E, a conductor 14 and substrate 16 are shown having a similar protrusion- or mesa-like profile to the device of FIGS. 6A to 6D. The substrate 16 of FIGS. 7A to 7E comprises a nitrogen-doped diamond substrate 44, and a layer of intrinsic diamond 46 epitaxially deposited thereon. Portions of both the substrate 44 and layer 46 are etched away to form the protrusion-like profile 43 to be subsequently arranged around the conductor 14 (FIG. 7D) before subsequent deposition of the control electrode 22 onto the substrate 44. The control electrode 22 is electrically isolated from the layer 46. By using nitrogen-doped diamond as a majority component of the device of FIGS. 7A to 7E and only using intrinsic diamond locally around the end 26 of the conductor 14, cheaper devices having similar performance to those made with a majority component of intrinsic diamond are obtained more quickly and cost-effectively. The electrode 22 is encapsulated in insulating layer 45 on the surface of the substrate 44, although it will be understood by persons skilled in the art that the electrode 22 may be encapsulated in any layer of insulating material 28, 30, 34 in accordance with one or more of the methods for doing so described above with reference to FIGS. 2 to 4. This protrusion- or mesa-like shape can also be seen in FIG. 7E, a similar structure would also be realised for FIG. 6 but with the additional layers as previously described.

Surfaces 42 shown in FIGS. 6 and 7 are treated to exhibit negative electron affinity and may be polished.

In each of the above-described embodiments, the void 19 between the anode 18 and the substrate 16 comprises either a vacuum of 10^(−5) millibars or less, or a gaseous environment of 50 millibars or less.

Figure 8:
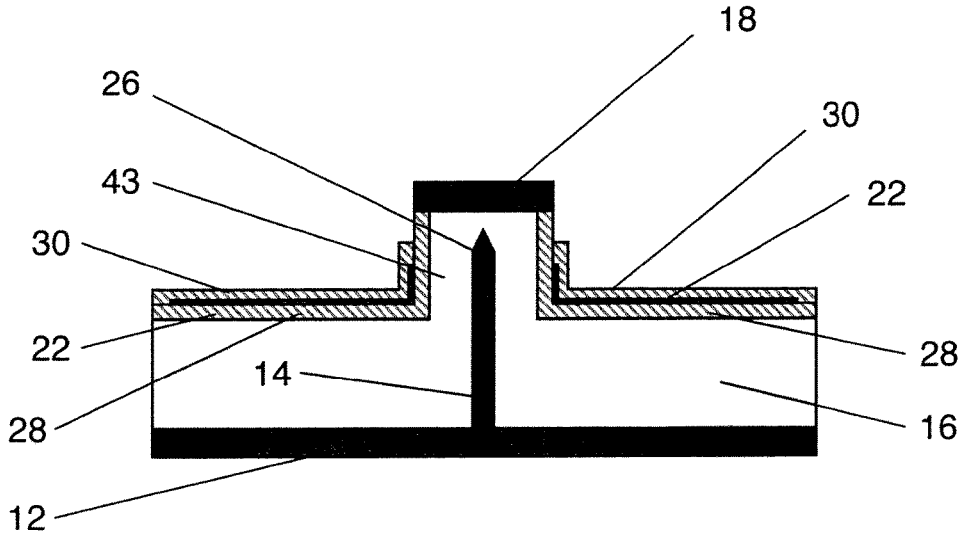
FIG. 8 shows a cross-sectional side view of an electron emitting device of a seventh embodiment of the present disclosure.
Figure 9:
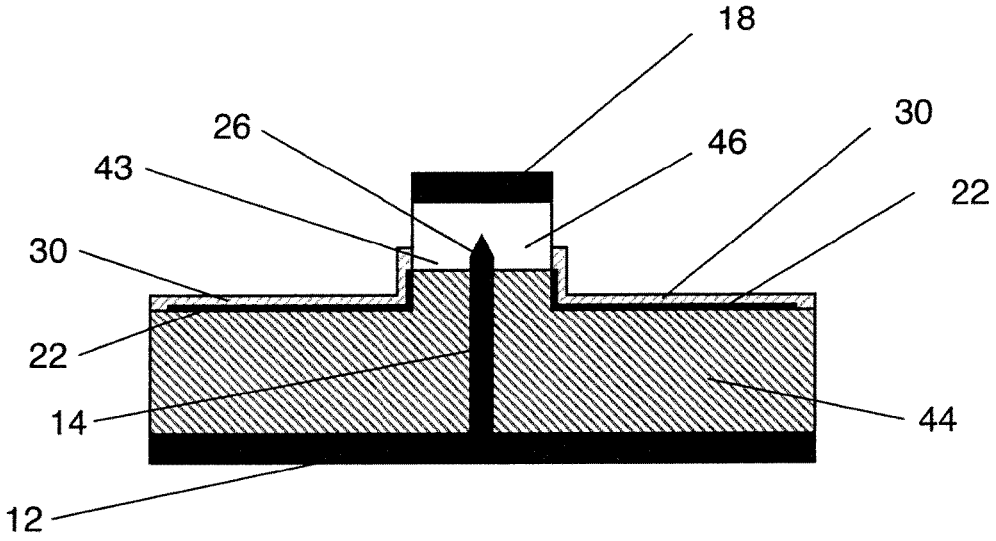
FIG. 9 shows a cross-sectional side view of an electron emitting device of an eighth embodiment of the present disclosure.

The embodiments shown in FIGS. 8 and 9 are similar to the embodiments shown in FIGS. 6 to 7, with the difference that the anodes 18 of FIGS. 8 and 9 are arranged in contact with the surface of the substrate 16, in contrast to being spaced therefrom. Preferably an ohmic contact is arranged between the anode 18 and the rest of the device where the anode 18 meets the substrate surface. The ohmic contact may be applied using deposition techniques. The devices of FIGS. 8 and 9 therefore each present a three terminal solid-state device, wherein current flow between the cathode 12 and anode 18 is regulated by a voltage applied to the control electrode 22, and wherein a vacuum is not required for the device to operate.

Figure 10:
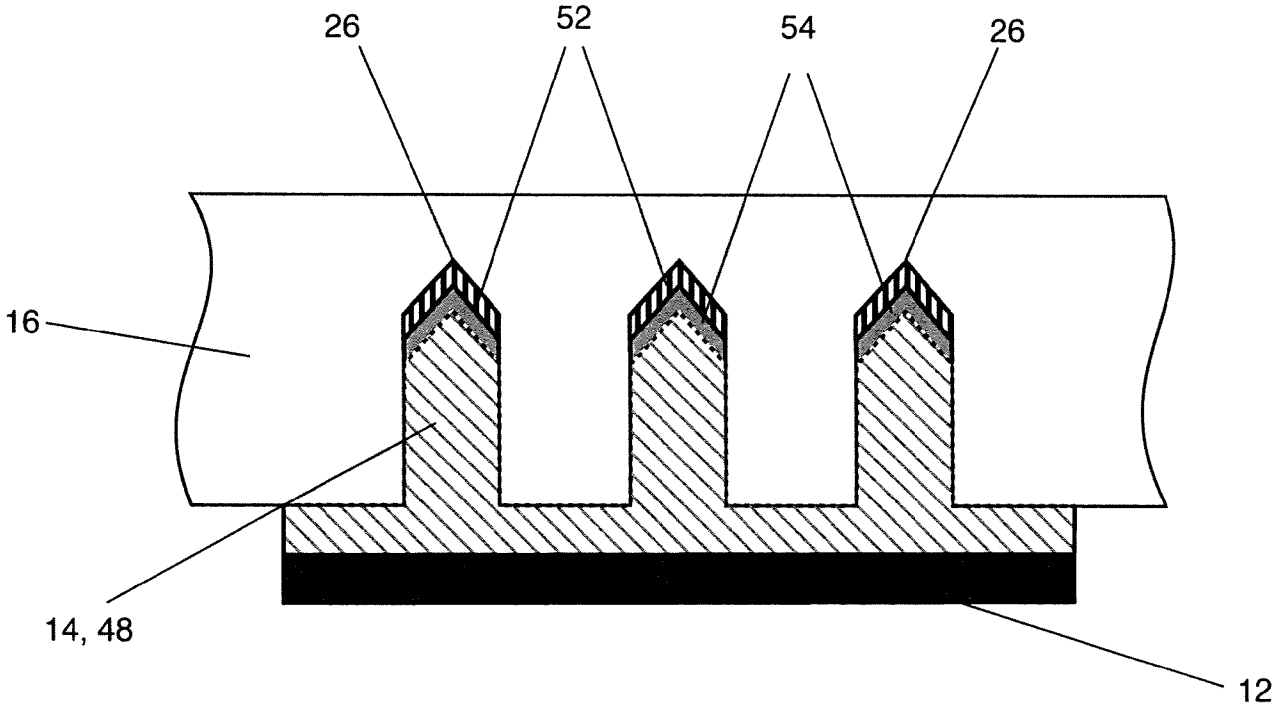
FIG. 10 shows a cross-sectional side view of three elongate electrical conductors of an electron emitting device according to any of the embodiments of FIGS. 1 to 9.

Referring to FIG. 10, three conductors 14 suitable for inclusion into any above-described embodiments are shown, in which a sub-structure can be seen. The conductors 14 are shown embedded in a substrate 16. The conductors 14 each comprise a metal portion 50 which exhibits the Schottky effect when in contact with diamond, such as gold, platinum, ruthenium, silver, and/or any metal that does not form a carbide with diamond when annealed. The conductors 14 can be manufactured by creating elongate holes 48 (FIG. 7B) in the substrate 16 by means of an etching process that yields a point with low radius of curvature, forming an n-type semiconducting region in the form of semiconductor layers 52 at the ends of the elongate holes 48, treating the semiconductor layers 52 to exhibit negative electron affinity at regions 54 adjacent metal portions 50, and filling the elongate holes 48 with the metal portions 50. The elongate holes 48 and metal portions 50 are preferably elongate in shape, and the metal portions preferably comprise a sharp termination point at their ends 26 to enhance electron emission.

The etching process and subsequent formation of the conductors 14 is disclosed in detail in European patent application number EP2605282A2.

In use, a cathode 12 and anode 18 of a device according to any above-described embodiment are provided with a potential difference therebetween which accelerates electrons emitted from a conductor 14 through a diamond substrate 16 and an aperture 24 of a control electrode 22 towards the anode 18. In the embodiments of FIGS. 1 to 7, the electrons are emitted from one or more emitting surfaces 42 before travelling across a void 19 and arriving at the anode 18. In the embodiments of FIGS. 8 to 10, the electrons arrive at the anode 18 via ohmic contacts arranged between the anode 18 and the rest of the device. The electron flow is altered by the control electrode 22, which is provided with a source 41 of at least one of voltage and current.

Figure 11:
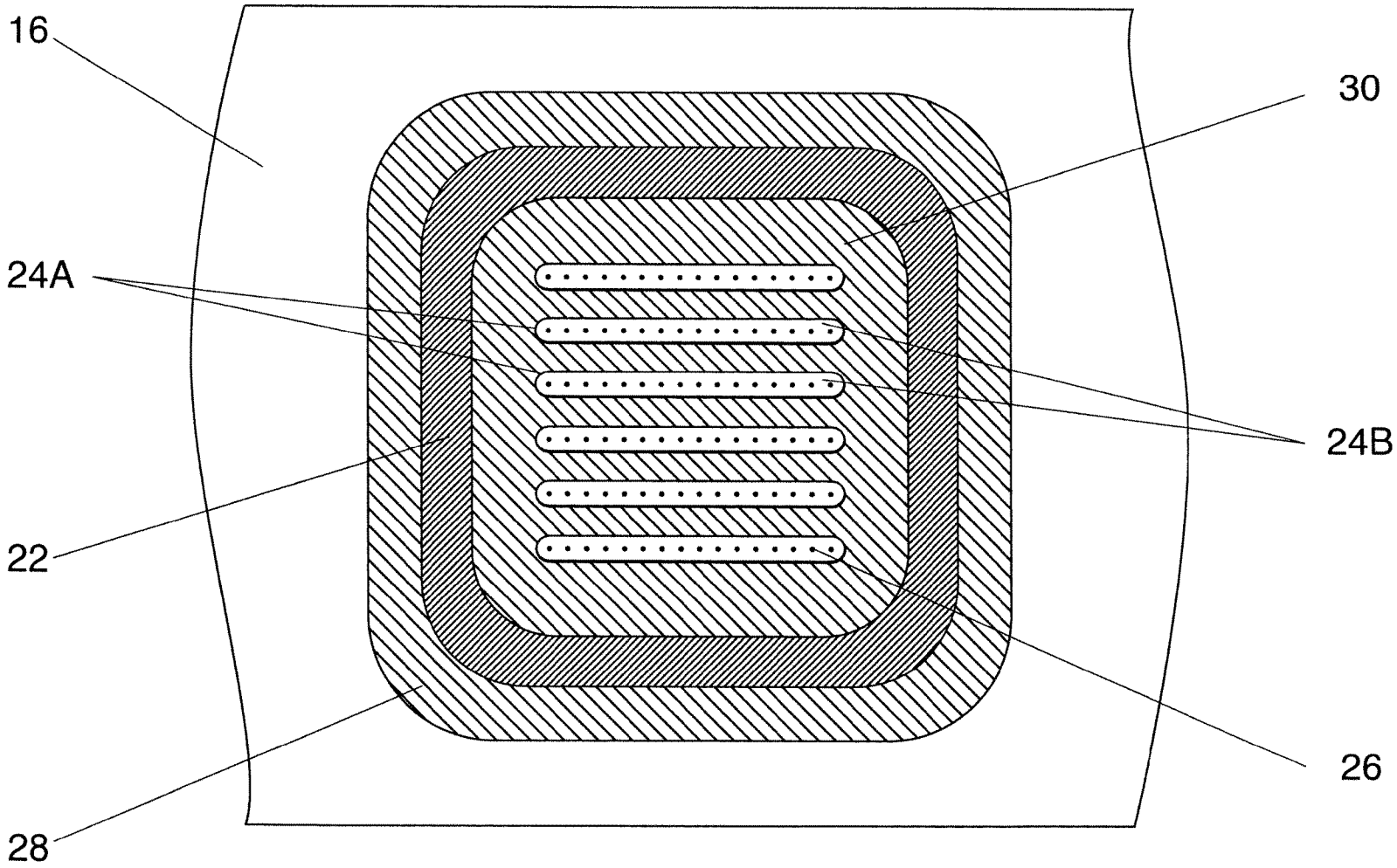
FIG. 11 shows a first control electrode structure for use with any of the embodiments of FIGS. 1 to 10.
Figure 12:
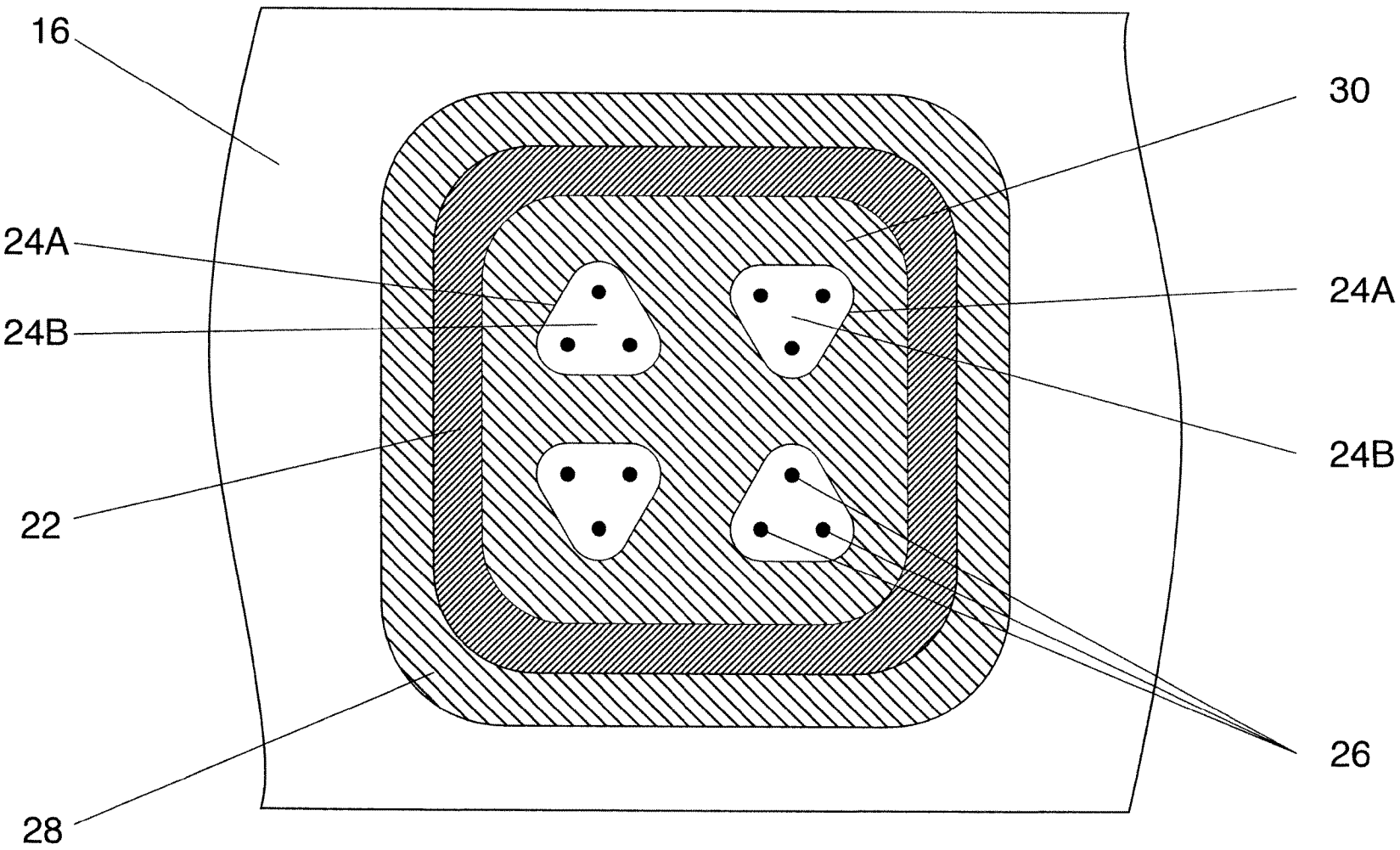
FIG. 12 shows a second control electrode structure for use with any of the embodiments of FIGS. 1 to 10.

FIG. 11 shows an example of a detailed control electrode structure for use with the device of any of the embodiments described above. The control electrode 22 is encapsulated between a lower insulating layer 28 on the diamond substrate 16 and an upper insulating layer 30. The control electrode 22 has aperture 24A which surrounds apertures 24B in the insulating layers 28, 30 to enable electron emission from tips 26 of conductors 14, wherein the tips 26 are arranged linearly within apertures 24B. The arrangement of FIG. 12 differs from that of FIG. 11 in that the tips 26 are arranged in triangular clusters in apertures 24B. The topologies in FIGS. 11 and 12 allow for shaping of the resultant electron beam, thereby providing advantages to users of the devices who require non-uniform beam shape.

Figure 13:
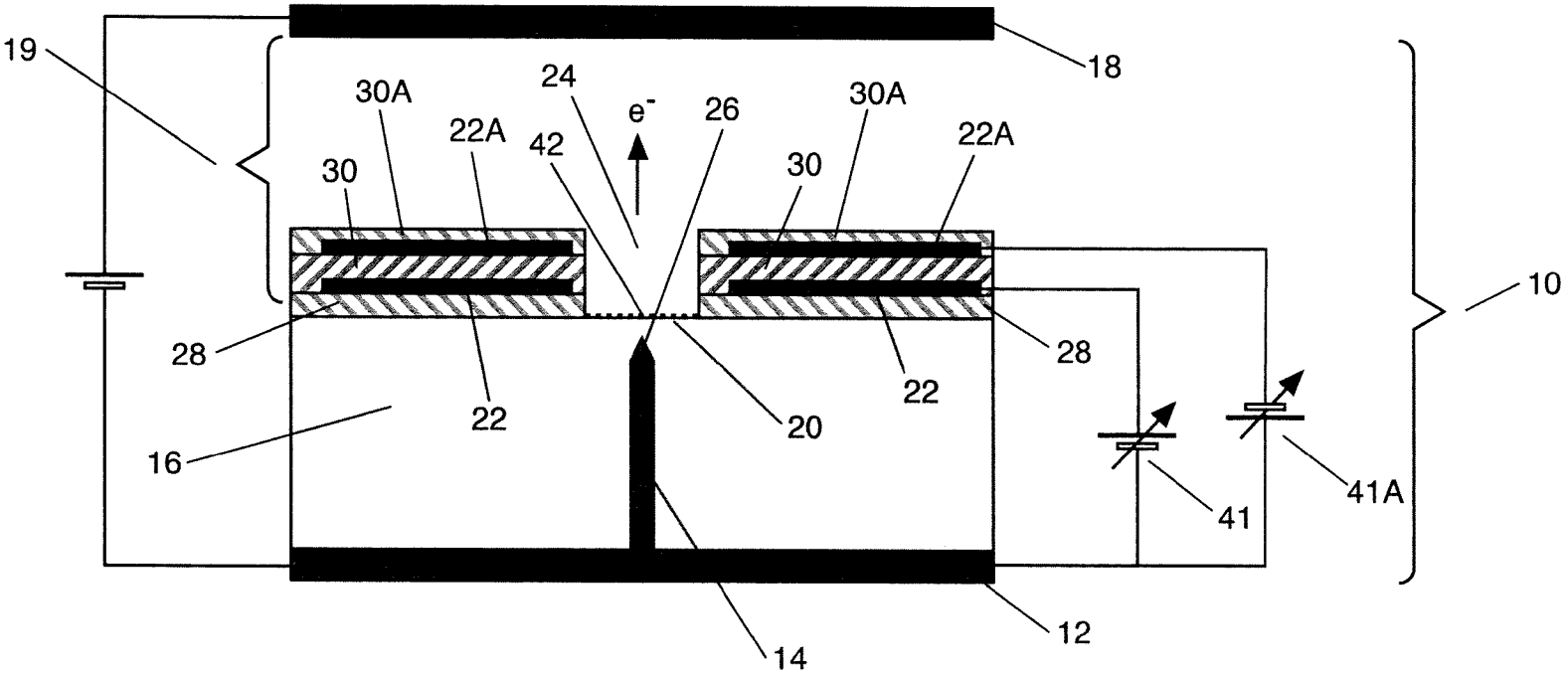
FIG. 13 shows a cross-sectional side view of an electron emitting device of a ninth embodiment of the present disclosure.

FIG. 13 shows a device of a ninth embodiment of the disclosure, in which first 22 and second 22A control electrodes are provided. The latter control electrode can also be encapsulated in an additional insulating layer 30A to provide additional protection to the additional gate. The provision of second control electrode 22A, which is negatively biased with respect to the cathode 12, enables focusing of the emitted stream of electrons. This provides the advantage of providing additional directionality in the electron beam.

According to an aspect of the present disclosure, there is provided a device for controlling electron flow, the device comprising:

a cathode;

at least one elongate electrical conductor embedded in a substrate comprising diamond, wherein the or each said conductor is in electrical communication with the cathode;

an anode, wherein the or each said conductor is adapted to emit electrons from an end thereof remote from the cathode through the substrate to the anode;

at least one control electrode for modifying the electric field in the region of the end of the or each said conductor; and at least one layer of insulating material wherein the or each said control electrode is separated from the or each said conductor by said insulating material, and wherein at least one said control electrode has at least one first aperture arranged such that electrons emitted from the end of the or each said conductor remote from the cathode pass through a said first aperture to said anode.

By providing such a device, the voltage required for electron emission to occur is reduced and the dependency of the voltage on the distance between the end of the conductor and the anode is removed. These changes lead to the advantage of providing a device having reduced power consumption for a given emission current density. Furthermore, accelerated ions are prevented from impacting the elongate electrical conductor due to the conductor being embedded in diamond, thereby providing the advantage of increasing the lifetime of the device. Total encapsulation of the elongate electrical conductor also provides the advantage of greater thermal stability of the conductor due to diamond's very high thermal conductivity. In addition, by providing at least one layer of insulating material wherein the or each said control electrode is separated from the or each said conductor by said insulating material, and wherein at least one said control electrode has at least one first aperture arranged such that electrons emitted from the end of the or each said conductor remote from the cathode pass through a said first aperture to said anode, provides the further advantage of minimising leakage current between the conductor and the or each control electrode whilst not impeding the electron path for electrons travelling through the diamond substrate to be subsequently emitted into vacuum and towards the anode.

A part of the substrate and the end of at least one said conductor may protrude through at least one said first aperture.

This provides the advantage of further concentrating the electric field around the end of the or each said conductor and in the region between the end of the or each conductor and the emission surface, thereby enhancing the field emission process by (a) reducing the cathode-control electrode voltage that needs to apply and (b) maintaining a high field in the tip-vacuum interface region so that ballistic election transport is maintained over a greater distance, thereby increasing emitted current.

At least one said control electrode may be encapsulated in at least one said layer of insulating material.

This provides the advantages of further reducing leakage current and protecting the or each control electrode from erosion due to ion feedback from residual gas ionisation in the vacuum.

The insulating material may comprise one or more of nitrogen-doped diamond, and nano-crystalline diamond although those skilled in the art could also alternatively utilise an insulating oxide compound or nitride compound layer.

The insulating material may have properties of thermal expansion relative to diamond sufficient to prevent damage to the device due to thermal cycling.

This provides the advantage of providing insulating material which is both thermally compatible with the substrate and isolates the or each control electrode from the substrate.

At least one said control electrode may comprise one or more of graphitic carbon, boron-doped diamond, and iridium.

This provides the advantage of providing an electrode material suitable for placement on diamond that can support additional subsequent homoepitaxial or heteroepitaxial diamond growth.

The boron-doped diamond of at least one said control electrode may comprise a doping density of 10^21 atoms or greater per cubic centimetre.

At least one said control electrode may comprise metallic material having a melting point of 1000 degrees Celsius or greater.

This provides the advantage of reducing the likelihood of thermal damage to the control electrode during the manufacturing process.

At least part of the substrate surface may have negative electron affinity.

This provides the advantage of altering the surface potential at the interface between the substrate and the space so as to increase the efficiency with which electrons are emitted from the substrate and into the space.

The space may comprise either (i) a vacuum of 10^(−5) millibars or less, or (ii) a gaseous environment of 50 millibars or less.

This provides the advantage of reducing the number of ions that are potentially damaging to the device.

At least one said layer of insulating material may have at least one second aperture arranged such that electrons emitted from the end of at least one said conductor remote from the cathode pass through at least one said second aperture to said anode.

The anode may be spaced from the substrate.

The device may further comprise at least one ohmic contact arranged between the anode and the substrate.

The device may comprise a plurality of said control electrodes.

This provides the advantage of further enhancing control of electrons emitted from the or each said conductor.

According to another aspect of the present disclosure, there is provided a method for manufacturing a device for controlling electron flow, the method comprising the steps of:

providing at least one elongate electrical conductor in electrical communication with a cathode;

embedding the or each said conductor in a substrate comprising diamond;

providing an anode, wherein the or each said conductor is adapted to emit electrons from an end thereof remote from the cathode through the substrate to the anode;

providing at least one control electrode for modifying the electric field in the region of the end of the or each said electrical conductor; and providing at least one layer of insulating material, wherein the or each control electrode is separated from the or each said conductor by said insulating material, and wherein at least one said control electrode has at least one first aperture arranged such that electrons emitted from the end of the or each said conductor remote from the cathode pass through a said first aperture to said anode.

The method may further comprise etching the substrate prior to arranging the or each said control electrode so that a part of the substrate and the end of at least one said conductor protrude through at least one said first aperture.

The method may further comprise encapsulating at least one said control electrode in at least one said layer of insulating material.

The step of encapsulating at least one said control electrode in insulating material may comprise: (a) arranging insulating material on the surface of the substrate; and (b) creating at least one layer of graphitic carbon in at least part of the insulating material, thereby forming at least one said control electrode.

The step of embedding the control electrode in insulating material may comprise: (i) arranging insulating material on the surface of the substrate; and (ii) creating a layer of graphitic carbon in at least part of the insulating material, thereby forming the electrode.

This provides the advantage of a simple and cost-effective method for forming a control electrode.

The step of embedding the electrode in insulating material may comprise: (i) depositing a first layer of insulating material on the surface of the substrate; (ii) depositing a metal layer on at least part of the first layer, thereby forming the control electrode; and (iii) depositing a second layer of insulating material on the metal layer.

This provides the advantage of providing a control electrode that is suitably matched to the lattice structure of diamond.

The step of embedding the electrode in insulating material may comprise: (i) depositing a first layer of insulating material on the surface of the substrate; (ii) depositing a metal layer on at least part of the first layer, thereby forming the control electrode; (iii) seeding the metal layer with nano-diamond powder; and (iv) growing nano-crystalline diamond on the seeded layer.

This provides the advantage of enabling a greater number of materials to be considered for the metal layer.

The method may further comprise the step of etching the insulating material to expose a portion of the substrate surface in the region of the end of the conductor.

This provides emitted elections with an optimal path from the conductor to the anode, thereby providing the advantage of increasing the efficiency of the device.

The etching may be performed using one or more of reactive ion etching and ion beam assisted etching.

This provides the advantage of providing a mechanism for etching the insulating material.

The substrate may comprise nitrogen-doped diamond.

This provides the advantage of reducing the cost of manufacturing the device.

The method may further comprise the step of growing intrinsic diamond on the nitrogen-doped diamond.

This provides the advantage of lowering the cost of the device without sacrificing the performance of the device.

The method may further comprise the step of treating at least part of the substrate surface to exhibit negative electron affinity.

This provides the advantage of reducing the voltage required to effect a given emission density.

According to a third aspect of the present disclosure, there is provided a device for controlling electron flow, the device comprising: a cathode; an elongate electrical conductor embedded in a substrate comprising diamond, wherein the conductor is in electrical communication with the cathode; an anode, wherein the conductor is adapted to emit electrons from an end thereof remote from the cathode through the substrate to the anode; and a control electrode provided on the substrate for modifying the electric field in the region of the end of the conductor, wherein a part of the substrate and the end of the conductor protrude through an aperture in the control electrode.

By providing such a device, the voltage required for electron emission to occur is reduced, thereby providing the advantage of a device having reduced power consumption for a given emission current density.

The device may further comprise at least one ohmic contact arranged between the anode and the substrate.

This provides the advantage of reducing the voltage required to collect the electrons.

Features of the embodiments described above in the singular are to be understood as also describing embodiments comprising a plurality of those features.

It will be appreciated by persons skilled in the art that the above embodiments have been described by way of example only and not in any limitative sense, and that various alterations and modifications are possible without departure from the scope of the disclosure as defined by the appended claims.

REFERENCE NUMERALS

10 device for controlling electron flow
12 cathode
14 elongate electrical conductor
16 diamond substrate
18 anode
19 void
20 substrate surface
22 control electrode
22A additional control electrode
24 control electrode aperture
26 end of conductor
28 lower gate insulating layer
29 implant mask
30 upper gate insulating layer
30A additional upper gate insulating layer
31 ion species
32 nano-diamond powder layer
34 nano-crystalline diamond layer
35 heteroepitaxial diamond layer
36 graphitic carbon control electrode
38 metal layer
40 electrical contact
41 gate control power supply
41A additional gate control power supply
42 surface treated to exhibit negative electron affinity
43 protrusion
44 nitrogen-doped diamond substrate
45 nitrogen-doped diamond layer
46 layer of intrinsic diamond
48 elongate hole
50 metal portion
52 semiconductor layer
54 region adjacent end of conductor

The invention claimed is:

1. A method for manufacturing a device for controlling electron flow, the method comprising the steps of:

providing at least one elongate electrical conductor in electrical communication with a cathode;

embedding the or each said conductor in a substrate comprising diamond;

providing an anode, wherein the or each said conductor is adapted to emit electrons from an end thereof remote from the cathode through the substrate to the anode;

providing at least one control electrode for modifying the electric field in the region of the end of the or each said electrical conductor; and providing at least one layer of insulating material, wherein the or each control electrode is separated from the or each said conductor by said insulating material, and wherein at least one said control electrode has at least one first aperture arranged such that electrons emitted from the end of the or each said conductor remote from the cathode pass through a said first aperture to said anode.

2. The method of claim 1, further comprising etching the substrate prior to arranging the or each said control electrode so that a part of the substrate and the end of at least one said conductor protrude through at least one said first aperture.

3. The method of claim 1, further comprising encapsulating at least one said control electrode in at least one said layer of insulating material.

4. The method of claim 3, wherein the step of encapsulating at least one said control electrode in insulating material comprises: (a) arranging insulating material on the surface of the substrate; and (b) creating at least one layer of graphitic carbon in at least part of the insulating material, thereby forming at least one said control electrode.

5. The method of claim 3, wherein the step of encapsulating at least one said control electrode in insulating material comprises: (a) depositing a first layer of insulating material on the surface of the substrate; (b) depositing at least one metal layer on at least part of the first layer, thereby forming at least one said control electrode; and (c) depositing a second layer of insulating material on at least one said metal layer.

6. The method of claim 3, wherein the step of encapsulating at least one said control electrode in insulating material comprises: (a) depositing at least one first layer of insulating material on the surface of the substrate; (b) depositing at least one metal layer on at least part of at least one said first layer, thereby forming at least one said control electrode; (c) seeding at least one said metal layer with nano-diamond powder; and (d) growing nano-crystalline diamond on at least one said seeded layer.

7. The method of claim 1, wherein the substrate comprises nitrogen-doped diamond.

8. The method of claim 7, further comprising growing intrinsic diamond on the nitrogen-doped diamond.

9. The method of claim 1, further comprising treating at least part of the substrate surface to exhibit negative electron affinity.

10. The method of claim 1, further comprising etching the insulating material to expose a portion of the substrate surface in the region of the end of at least one said conductor.

11. The method of claim 10, wherein the etching is performed using one or more of reactive ion etching and ion beam assisted etching.

12. The method of claim 1, further comprising providing at least one second aperture in at least one said layer of insulating material, such that electrons emitted from the end of at least one said conductor remote from the cathode pass through at least one said second aperture to said anode.

13. The method of claim 1, further comprising providing a plurality of said control electrodes.

* * * * *